US006975297B2

(12) United States Patent
Saishu et al.

(10) Patent No.: US 6,975,297 B2
(45) Date of Patent: Dec. 13, 2005

(54) LIQUID-CRYSTAL DISPLAY DRIVING METHOD USING ASYMMETRIC DRIVING VOLTAGE

(75) Inventors: Tatsuo Saishu, Tokyo (JP); Haruhiko Okumura, Fujisawa (JP); Kohki Takatoh, Yokohama (JP); Hajime Yamaguchi, Yokohama (JP); Rei Hasegawa, Yokohama (JP); Hitoshi Kobayahi, Kawasaki (JP); Rieko Fukushima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 371 days.

(21) Appl. No.: 10/175,899

(22) Filed: Jun. 21, 2002

(65) Prior Publication Data

US 2003/0006950 A1 Jan. 9, 2003

(30) Foreign Application Priority Data

Jun. 21, 2001 (JP) ..... 2001-188686

(51) Int. Cl.[7] ..... G09G 3/36

(52) U.S. Cl. ..... 345/94; 345/96; 345/208; 345/209; 345/97; 349/37

(58) Field of Search ..... 345/87–101, 208–209; 349/37, 100

(56) References Cited

U.S. PATENT DOCUMENTS 6,297,792 B1 * 10/2001 Takahashi ..... 345/91
6,344,889 B1 2/2002 Hasegawa et al.
6,496,170 B1 * 12/2002 Yoshida et al. ..... 345/87

FOREIGN PATENT DOCUMENTS

JP 11-133380 5/1999
JP 2000-292774 * 10/2000

OTHER PUBLICATIONS

Pauwels et al., "Analysis of the Asymmetic Continuous Director Rotation Mode of Ferroelectric Liquid Crystal Displays;" Conference Record of the 20$^{th}$ International Display Research Conference, pp. 72–75, Sep. 25, 2000.

Saishu et al., U.S. Appl. No. 09/942,743, filed Aug. 31, 2001.

Hasegawa et al., U.S. Appl. No. 09/801,812, filed Mar. 9, 2001.

Baba et al., U.S. Appl. No. 09/899,220, filed Jul. 6, 2001.

* cited by examiner

*Primary Examiner*—Amr A. Awad
(74) *Attorney, Agent, or Firm*—Finnegan, Henderson, Farabow, Garrett & Dunner, L.L.P.

(57) ABSTRACT

Disclosed is a method for driving an active matrix type liquid crystal display device including a first electrode, a second electrode, and a liquid crystal layer interposed between the first and the second electrodes, and the liquid crystal layer having a larger polarization when a voltage of a first polarity is applied to the first electrode against the second electrode than that when a voltage of a second polarity different from the first polarity is applied to the first electrode against the second electrode, the method comprising dividing a frame into a first field and a second field, applying a first voltage of the first polarity to the first electrode during the first field, generating a second voltage from the first voltage by changing its polarity, a magnitude of the second voltage being modified by an amount of $\Delta V$ ($\Delta V \neq 0$) based on a magnitude of the first voltage in a direction of the first polarity when the first voltage is not zero, and applying the second voltage to the first electrode during the second field.

15 Claims, 8 Drawing Sheets

LIQUID-CRYSTAL DISPLAY DRIVING METHOD USING ASYMMETRIC DRIVING VOLTAGE

CROSS-REFERENCE TO THE RELATED APPLICATIONS

This application is based upon and claims the benefit of priority from the prior Japanese Patent Application No. 2001-188686, filed Jun. 21, 2001, the entire contents of which are incorporated herein by reference.

BACKGROUND OF THE INVENTION

1. Field of the Invention

The present invention relates to a method of driving a liquid-crystal display device.

2. Description of the Related Art

A liquid-crystal display is generally a hold type of display that continues to hold display of the previous frame and not an impulse type of display as with CRTs (Cathode Ray Tubes). For this reason, image-blurring effects become a problem at the time of displaying moving image.

In observing a moving object on a display screen, the moving object image in a frame continues to be displayed in the same position until switching is made to the next frame. Nevertheless, human eyes will continuously follow the moving object. As a result, the image blurring effects occur. In other words, although the movement of the moving object displayed on the screen is discontinuous, human eyes will recognize the moving object in such a way as to interpolate between images of successive frames because of the continuity of their follow-up motion. This is the cause of the image blurring effects.

To solve the image blurring effects, a method has been proposed which divides one frame into an image display interval and a black display interval through the use of a fast response liquid crystal, such as an OCB (Optically Compensated Bend) mode liquid crystal or a ferroelectric liquid crystal.

One such method is field inversion driving (see, for example, Japanese Unexamined Patent Publication No. 2000-10076). In this field inversion driving, one frame is divided into two fields, and the liquid crystal layer is placed in the transparent state in the first field and in the nontransparent state in the second field. As the liquid crystal layer use is made of a liquid crystal that induces spontaneous polarization the magnitude of which varies with the polarity of applied voltage. That is, use is made of a liquid crystal in which the induced spontaneous polarization exhibits an asymmetric response when the polarity of applied voltage is changed. In this specification, a liquid crystal having such response characteristics is referred to as an asymmetric response liquid crystal. One such liquid crystal is a monostable ferroelectric liquid crystal, which has a fast response. To make a ferroelectric liquid crystal monostable, there are two methods: one to introduce a polymer network into the liquid crystal layer and one to subject the liquid crystal layer to an initial alignment process by cooling it slowly with a DC voltage applied thereto.

With the aforementioned liquid crystal display device, for example, in the first field the liquid crystal layer is driven with positive polarity for writing and in the second field it is driven with negative polarity for erasing (resetting). Thereby, AC driving is accomplished. In this case, the positive polarity is that to which the polarization responds (or the polarity to which the polarization responds to a larger degree). In other words, the positive polarity is that under which the change of light transmittance of the liquid crystal display device is greater. On the other hand, the negative polarity is that to which the polarization does not respond (or the polarity to which the polarization responds to a smaller degree). That is, the negative polarity is that under which the change of light transmittance of the liquid crystal display device is smaller.

In the case of the AC driving, if a DC component remains across the liquid crystal layer for a time much longer than one frame period, image sticking will occur. Thus, the driving should be performed so that no DC component will remain across the liquid crystal layer. Conventionally, it has been believed that the driving by voltages having the same amplitude but opposite polarity will eliminate the DC component and prevent the image sticking.

With the above driving method, the hold voltage between electrodes of each pixel becomes symmetrical. In practice, however, insulating films, including alignment films, are interposed between the electrodes and the liquid crystal layer. With a liquid crystal display device using an asymmetric response liquid crystal, the effective dielectric constant of the liquid crystal is asymmetric. Thus, the voltage divided into the liquid crystal layer and the insulating films becomes asymmetric. Thus, the DC component will remain across the liquid crystal layer. Experiments also confirmed that the imaging sticking occurred.

Thus, although a proposal has been made for an impulse type of display using an asymmetric response liquid crystal in order to prevent image blurring effects in moving image display, the conventional driving method presents a problem of the occurrence of image sticking due to application of a DC component across the liquid crystal layer.

An object of the present invention to provide a liquid crystal display driving method which permits the liquid crystal layer to be prevented from being impressed with a DC component.

BRIEF SUMMARY OF THE INVENTION

According to an aspect of the present invention, there is provided a method for driving an active matrix type liquid crystal display device including a first electrode, a second electrode, and a liquid crystal layer interposed between the first and the second electrodes, and the liquid crystal layer having a larger polarization when a voltage of a first polarity is applied to the first electrode against the second electrode than that when a voltage of a second polarity different from the first polarity is applied to the first electrode against the second electrode, the method comprising: dividing a frame into a first field and a second field; applying a first voltage of the first polarity to the first electrode during the first field; generating a second voltage from the first voltage by changing its polarity, a magnitude of the second voltage being modified by an amount of $\Delta V$ ($\Delta V \neq 0$) based on a magnitude of the first voltage in a direction of the first polarity when the first voltage is not zero; and applying the second voltage to the first electrode during the second field.

DETAILED DESCRIPTION OF THE INVENTION

First, the basic principles of an embodiment of the present invention will be described.

Figure 1:
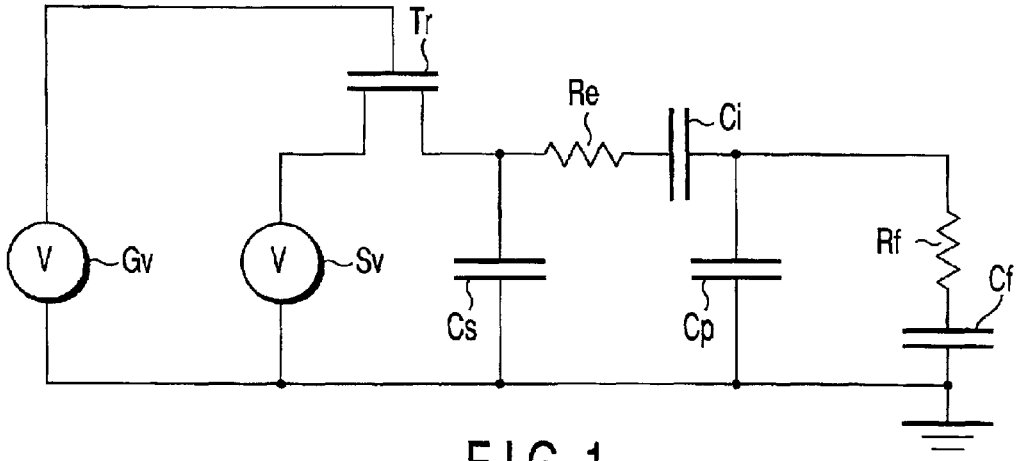
FIG. 1 shows an equivalent circuit model of a liquid crystal display device according to an embodiment of the present invention.

FIG. 1 shows an equivalent circuit model of the liquid crystal display device according to the embodiment of the present invention.

In FIG. 1, Cf represents the capacitance corresponding to spontaneous polarization of the liquid crystal layer (asymmetric response liquid crystal), Rf the resistance for representing the speed of response (corresponding to Cf×Rf) of the liquid crystal layer, Cp the normal dielectric capacitance of the liquid crystal layer (capacitance at high frequencies), Ci the capacitance of insulating films (including an alignment film) interposed between the liquid crystal layer and electrodes, Re the electrode-associated resistance, and Cs the storage capacitance. Further, Tr represents a thin-film transistor (TFT) used as a switching element, Gv a control signal source for on—off control of the thin-film transistor Tr, and Sv a display signal source that supplies a display signal to a pixel through the transistor Tr.

Using the equivalent circuit model as shown in FIG. 1 and assuming the capacitance Cf corresponding to spontaneous polarization to be zero on the negative polarity side (on the side in which the amount of response of polarization is small), the following calculations were made:

$$V_h(+) = [(C_i + C_p + C_f)(C_iC_p + C_s(C_i + C_p))V - C_fC_iQ_0]/[(C_i + C_p)(C_iC_p + C_s(C_i + C_p) + C_f(C_i + C_s))]$$

$$V_{lc}(+) = [(C_iC_p + C_s(C_i + C_p))(C_iV + Q_0)]/[(C_i + C_p)(C_iC_p + C_s(C_i + C_p) + C_f(C_i + C_s))]$$

$$V_h(-) = -[(C_i + C_p + C_f)(C_iC_p + C_s(C_i + C_p))V - C_fC_iQ_0]/[(C_i + C_p)(C_iC_p + C_s(C_i + C_p) + C_f(C_i + C_s))] = -V_h(+)$$

$$V_{lc}(-) = [-\{(C_i + C_p + C_f)(C_iC_p + C_s(C_i + C_p))\}C_iV + \{(C_i + C_p + C_f)(C_iC_p + C_s(C_i + C_p)) + 2C_fCi^2\}Q_0]/[(C_i + C_p)^2(C_iC_p + C_s(C_i + C_p) + C_f(C_i + C_s))]$$

$$V_{dc} = V_{lc}(+) + V_{lc}(-) = [-(C_iC_p + C_s(C_i + C_p))C_fC_iV + \{(2C_i + 2C_p + C_f)(C_iC_p + C_s(C_i + C_p)) + 2C_fCi^2\}Q_0]/[(C_i + C_p)^2(C_iC_p + C_s(C_i + C_p) + C_f(C_i + C_s))]$$

where $V_h(+)$ is the pixel hold voltage on the positive side (the voltage applied between electrodes), $V_{lc}(+)$ is the liquid crystal hold voltage on the positive side (the voltage applied across the liquid crystal layer itself), $V_h(-)$ is the pixel hold voltage on the negative side, $V_{lc}(-)$ is the liquid crystal hold voltage on the negative side, $V_{dc}$ is the stationary value of the DC component $V_{dc}$ in the case of symmetric driving, V is the signal amplitude, and $Q_0$ is the initial charge remaining in the liquid crystal layer when the voltage is zero.

Although the hold voltage of the entire liquid crystal cell including insulating films such as alignment films is symmetrical, a DC component is produced across the liquid crystal layer. The DC component is voltage dependent. For example, with a method for effecting asymmetrical driving by shifting a common voltage by a constant value, it is impossible to remove the DC component perfectly.

In order to cancel the asymmetrical property (the DC component) of the liquid crystal layer, it is required to shift the reset side voltage (the negative polarity side voltage) in a direction that reduces it. The DC component has a component caused by the asymmetrical property of the voltage—light transmittance characteristics (V–T characteristics) and a component caused by the polarity-dependent difference in speed of response. The latter component is greatly temperature dependent. For voltages in which the latter component becomes large, therefore, it is desired to make temperature compensation.

Specifically, by replacing V in $V_{lc}(+)$ with $\alpha_+$V1 and V in $V_{lc}(-)$ with $\alpha_-$(V1−ΔV) and then solving $V_{lc}(+)=-V_{lc}(-)$, the theoretical value ΔV for V1 can be determined. Here, $\alpha_+$ and $\alpha_-$ are the rates of response for rising and falling voltages, respectively, and used to convert the voltage in the equations to the average voltage over one field.

Figure 2:
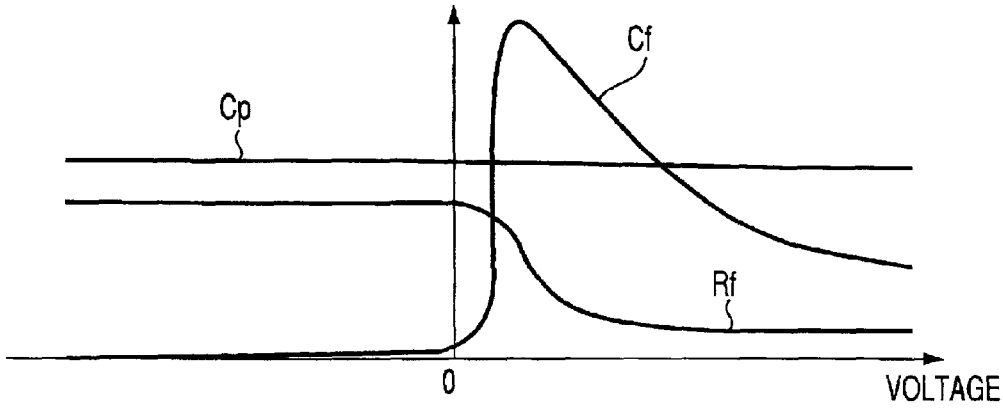
FIG. 2 shows the voltage dependence of circuit elements shown in FIG. 1.

The voltage dependence of the capacitance values and the resistance values of the circuit elements were computed by measuring a test sample. The computational results are shown in FIG. 2. The voltage dependence of these equivalent circuit parameters can be found through measurement of voltage holding ratio and D-E hysteresis curves.

Figure 3:
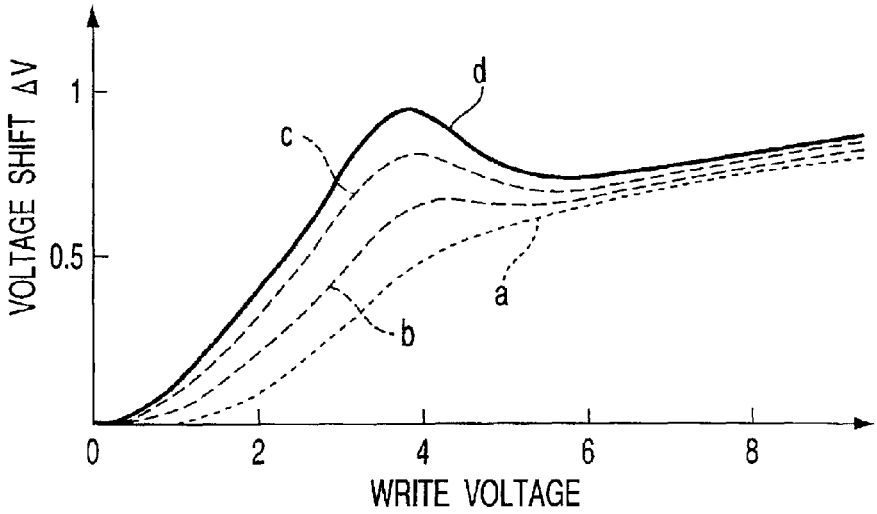
FIG. 3 shows plots of the voltage shift versus the write voltage for different values of temperature.
Figure 4:
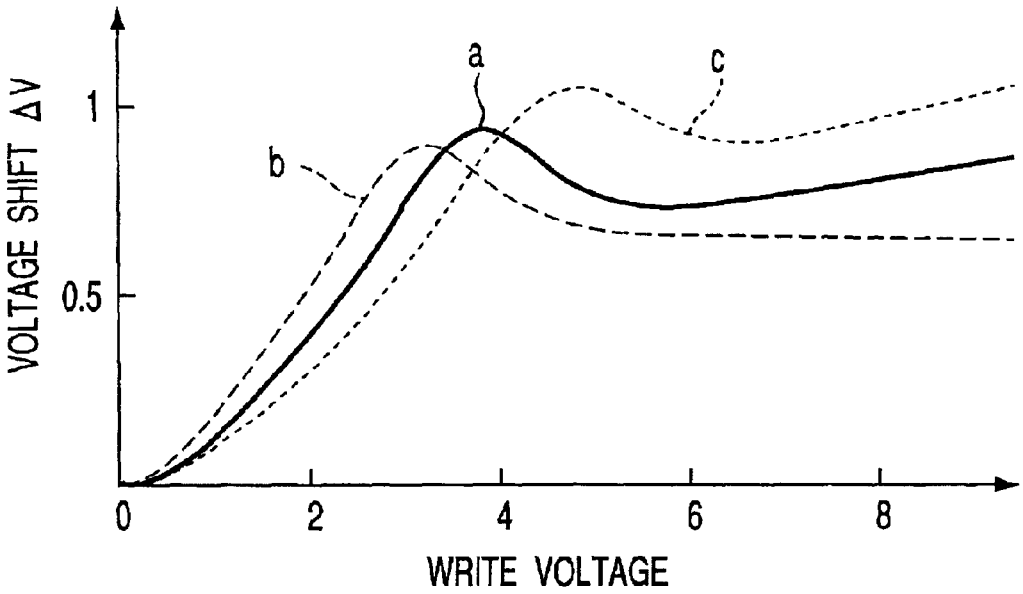
FIG. 4 shows plots of the voltage shift versus the write voltage for different values of spontaneous polarization.
Figure 5:
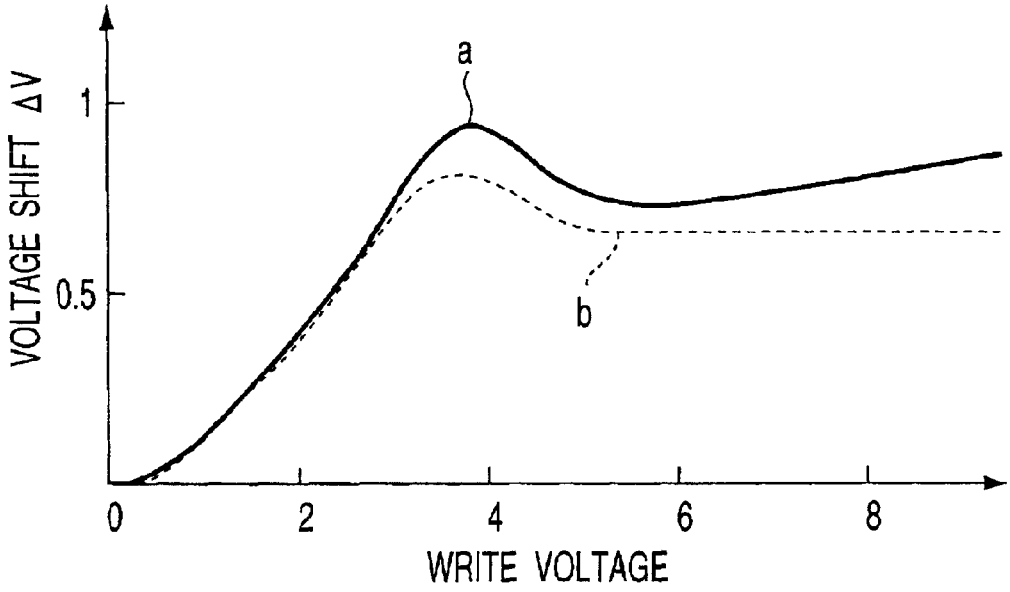
FIG. 5 shows plots of the voltage shift versus the write voltage for different values of storage capacitance.

In general, the response on the write side (on the positive polarity side) (particularly over a range of low to intermediate voltage) is slower than the response on the reset side (on the negative polarity side). Thus, the computations were made taking into consideration the polarity-dependent difference in speed of response. The computational results are shown in FIGS. 3, 4 and 5. In these figures, the values of the write side voltage are shown on the horizontal axis and the voltage shift amount ΔV of the reset side voltage for eliminating the DC component applied to the liquid crystal layer is shown on the vertical axis.

FIG. 3 shows plots of the voltage shift amount ΔV versus the write voltage for different values of temperature. The curve a indicates characteristics when there is little temperature dependence. The curves b, c and d indicate characteristics when the temperature is lowered progressively in the order mentioned. The curve d indicates characteristics at room temperature. FIG. 4 shows plots of the voltage shift amount ΔV versus the write voltage for different values of spontaneous polarization. The curve a corresponds to the curve d in FIG. 3. The curve b indicates characteristics when the value of spontaneous polarization is ⅔ times that in the case of the curve a. The curve c indicates characteristics when the value of spontaneous polarization is ⅔ times that in the case of the curve a. FIG. 5 shows plots of the voltage shift amount ΔV versus the write voltage for different values of storage capacitance. The curve a corresponds to the curve d in FIG. 3. The curve b indicates characteristics when the value of that storage capacitance is three times that in the case of the curve a.

In the calculations to obtain the graphs of FIGS. 3, 4 and 5, the voltage shift is set to zero in order to increase contrast with the light transmittance for black display suppressed in a region in which the write voltage is near zero. When the DC component of the voltage applied to the liquid crystal layer is set to zero completely, the reset voltage theoretically becomes positive in the region in which the write voltage is near zero. As a result, ΔV may become larger than V1. In such a case, the light transmittance of the liquid crystal layer increases, resulting in unclear black display. Thus, the voltage shift is set to zero so that the reset voltage does not become positive.

As can be seen from FIGS. 3, 4 and 5, the voltage shift ΔV tends to increase as the write voltage increases. As the write voltage increases, the voltage shift ΔV may increase monotonously or may have an inflection point or a maximum point. The characteristic of the voltage shift ΔV need not necessarily to be continuously curved as shown in FIGS. 3, 4 and 5 but may be in the form of a polygonal line or stair-like line. The characteristic of the voltage shift ΔV may also be approximated by a simple line.

The reason why the voltage shift ΔV tends to increase as the write voltage increases is that the spontaneous polarization increases with increasing write voltage, or increasing voltage applied to the liquid crystal layer. Further, the reason why the voltage shift ΔV exhibits a peak at intermediate write voltages is that the polarity-dependent difference in speed of response of spontaneous polarization becomes large at intermediate write voltages.

Figure 6:
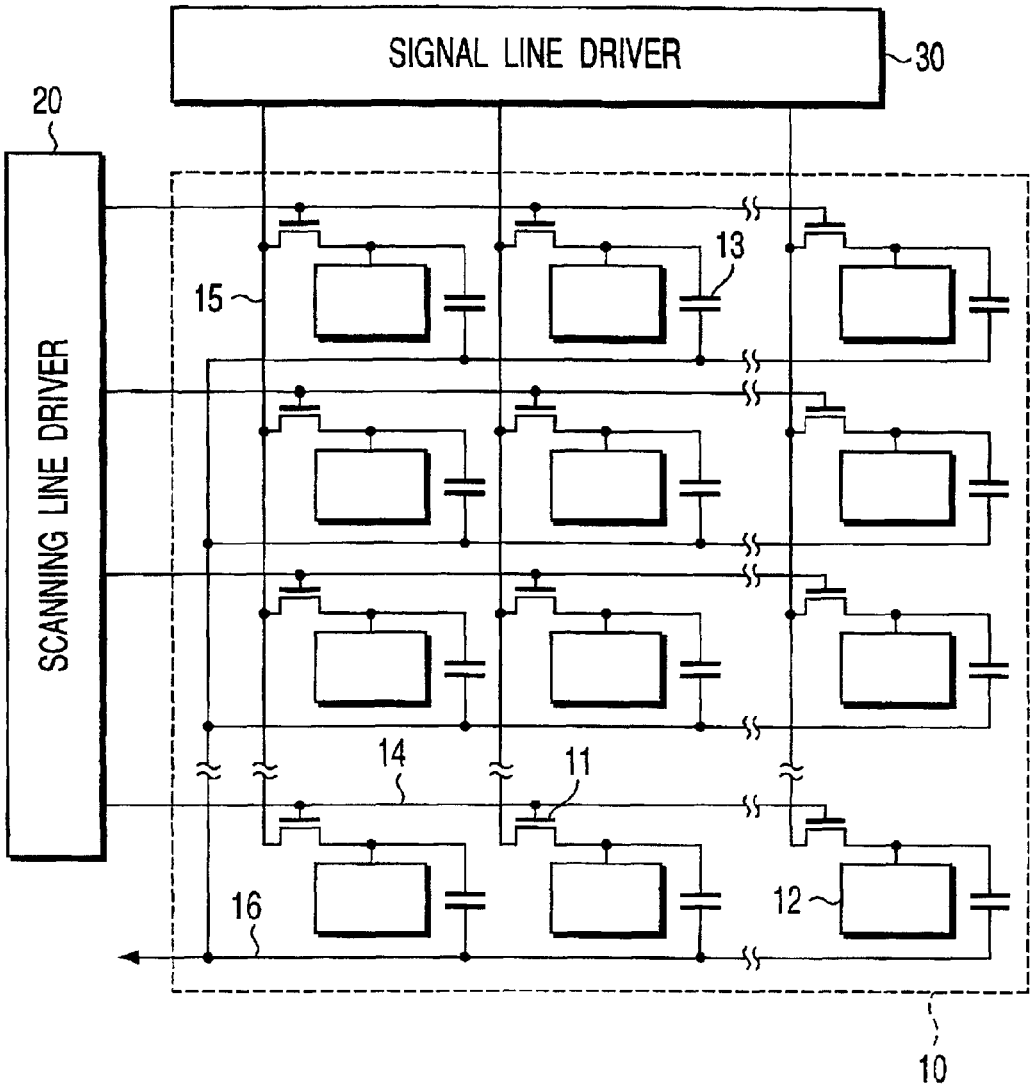
FIG. 6 shows a configuration of the liquid crystal display device and its associated driving circuits according to an embodiment of the present invention.

FIG. 6 shows a liquid crystal display device and its associated drive circuits according to the embodiment of the present invention.

A liquid crystal display panel 10 is comprised of an array plate, an opposite plate that is opposed to the array plate, and a liquid crystal layer interposed between the array plate and the opposed plate. The array plate is formed with switching elements 11 each formed of a TFT, pixel electrodes 12 each connected with a corresponding one of the switching elements 11, storage capacitors 13 each having its one end connected with a corresponding one of the switching elements 11, scanning lines 14 each connected with the switching elements 11 in a corresponding row, signal lines 15 each connected with the switching elements 11 in a corresponding column, and storage capacitor lines 16 connected together to the other ends of the storage capacitors. The opposite plate is formed with an electrode which is opposite the array plate and set at a potential which is the same as the potential on the storage capacitor lines 16.

Each of the array plate and the opposite plate is formed with an alignment film on its region of contact with the liquid crystal layer. An inorganic insulating film may be formed between the pixel electrodes and the alignment film to prevent short-circuiting. To minimize voltage loss, it is desired to reduce the thickness of the alignment film interposed between the pixel electrodes and the liquid crystal layer and the short-circuit preventing insulation film to the extent that their functions are not damaged. The thickness of the alignment film should preferably be not larger than 30 nm. The scanning lines are driven by the scanning line drive circuit 20 and the signal lines 15 are driven by the signal line drive circuit 30.

Figure 7:
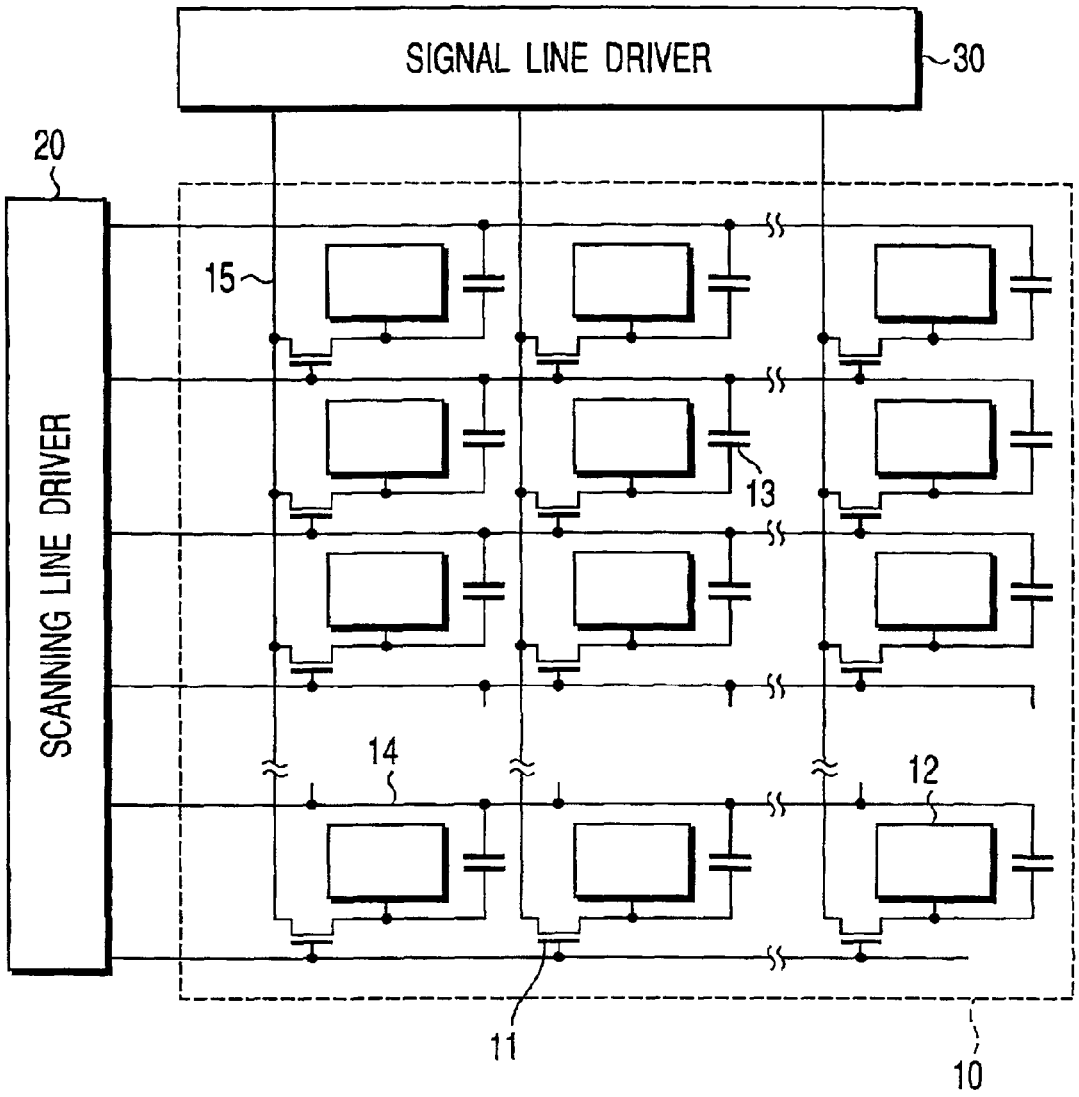
FIG. 7 shows another configuration of the liquid crystal display device and its associated driving circuits according to an embodiment of the present invention.

FIG. 7 shows another example of the liquid crystal display device and its associated drive circuits according to an embodiment of the present invention. Although, in the example of FIG. 6, the storage capacitor lines 16 are provided independently, in the example of FIG. 7 the scanning lines 14 are also used as the storage capacitor lines.

The liquid crystal layer used in the embodiment is obtained by monostabilizing a ferroelectric liquid crystal that causes phase transition among isotropic phase (Iso phase), cholesteric phase (Ch phase), and chiral smectic C phase (Sm C* phase).

Figure 8A:
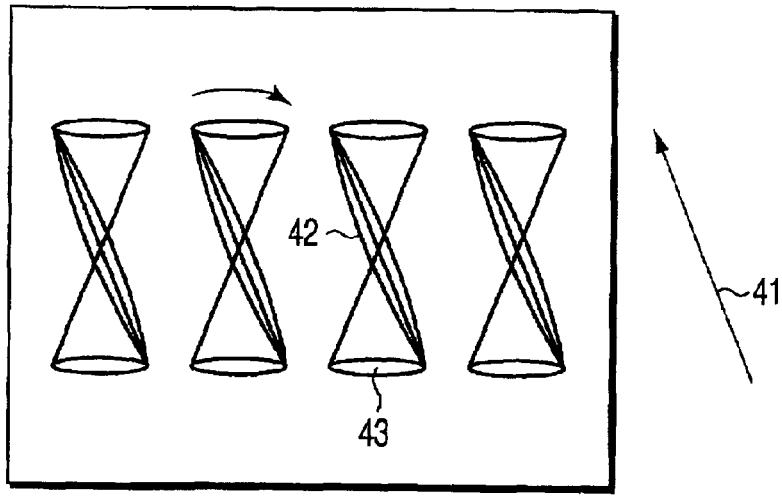
FIGS. 8A, 8B and 8C show alignment states of the liquid crystal used in the liquid crystal display device according to an embodiment of the present invention.
Figure 8B:
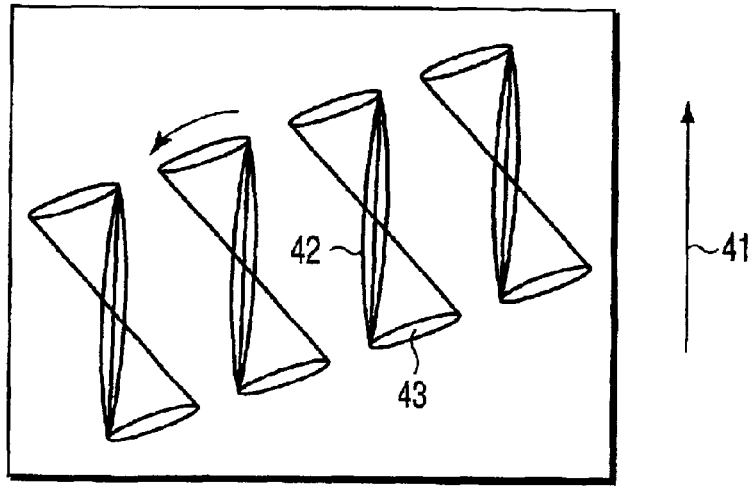
Figure 8C:
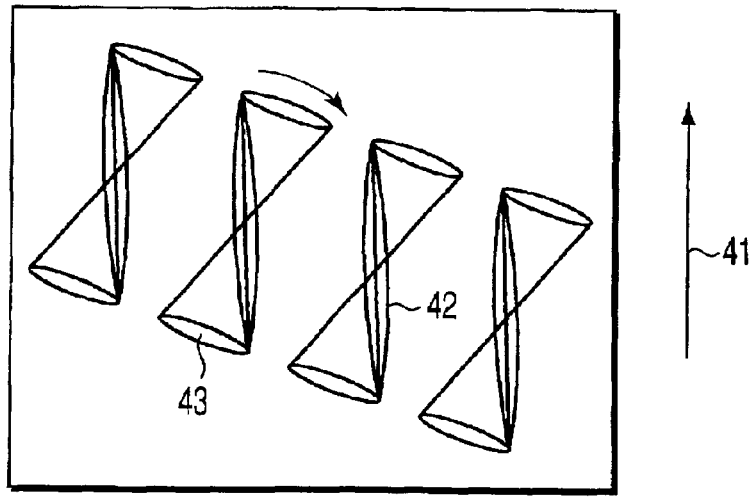

When no voltage is applied, the long axis of liquid crystal molecules 42 coincides with the uniaxial alignment treatment direction 41 (for example, the rubbing direction) as shown in FIGS. 8A, 8B and 8C. At the application of voltage of one polarity, the liquid crystal molecules 42 rotate along a conical surface 43. At the application of voltage of the other polarity, the liquid crystal molecules 42 stay in the uniaxial alignment treatment direction 41.

Here, let the refractive index anisotropy and the thickness of the liquid crystal layer be Δn and d, respectively. Then, the product Δn×d is set at ½ of the center frequency of transmitted light. In this case, when the molecules rotate through an angle of 45 degrees (go half around the conical surface), a maximum change in brightness is obtained. In forming the alignment state, the liquid crystal display panel is heated up to the Ch-phase temperature and then cooled down to the SmC*-phase temperature while a DC voltage of +1 to +5 V or −1 to −5 V is applied between the pixel electrodes and the opposite electrode. The polarity of the voltage applied at this time determines the direction in which the molecules rotate and the polarity to which the molecules respond (see FIGS. 8B and 8C). At the time of alignment state formation, the polarity of applied voltage may be changed for each pixel, each row, or each column.

Figure 9:
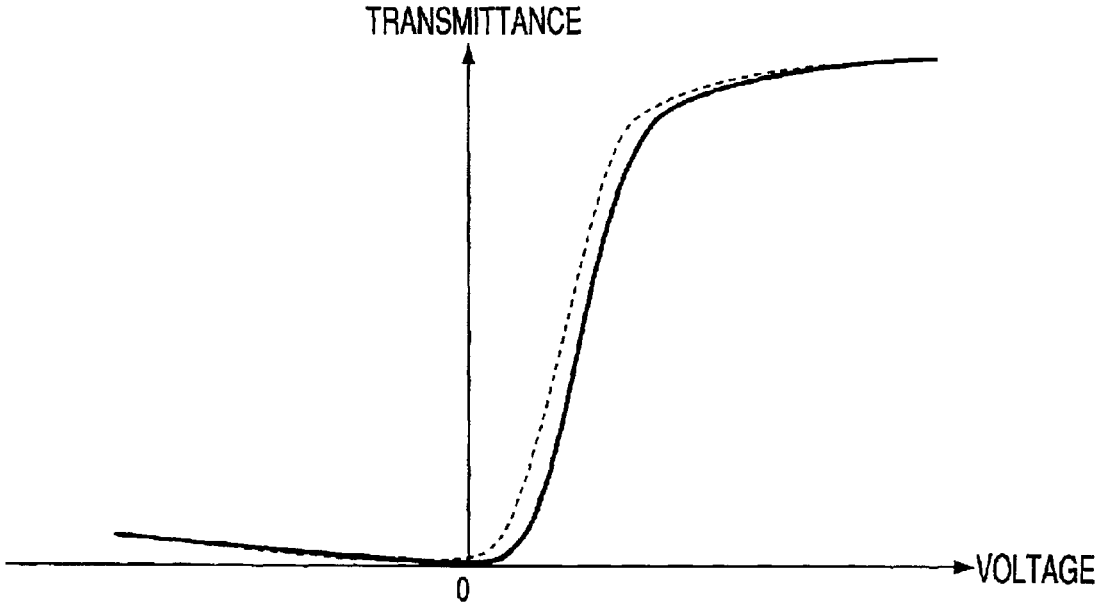
FIG. 9 shows light transmittance versus voltage characteristics of the liquid crystal display panel.

FIG. 9 shows the voltage versus light transmittance characteristics of the liquid crystal display panel. In the description which follows, unless otherwise specified, the polarizing plate is placed in the crossed-Nicole state so that black is displayed at zero voltage application (the normally black mode).

As a liquid crystal layer that exhibits similar characteristics, a polymer-stabilized ferroelectric liquid crystal can be used, which exhibits a similar response to that in FIG. 9. To form the polymer-stabilized ferroelectric liquid crystal, use is made of a mixture of optically unhardened liquid crystalline methacrylate and a ferroelectric liquid crystal. The mixture is irradiated for 30 seconds with ultraviolet rays having a wavelength 365 nm and an illuminance of 2 $mW/cm^2$ while a DC voltage is applied at the SmC-phase temperature (or the SmA-phase temperature), whereby the polymer-stabilized ferroelectric liquid crystal is obtained.

Figure 10:
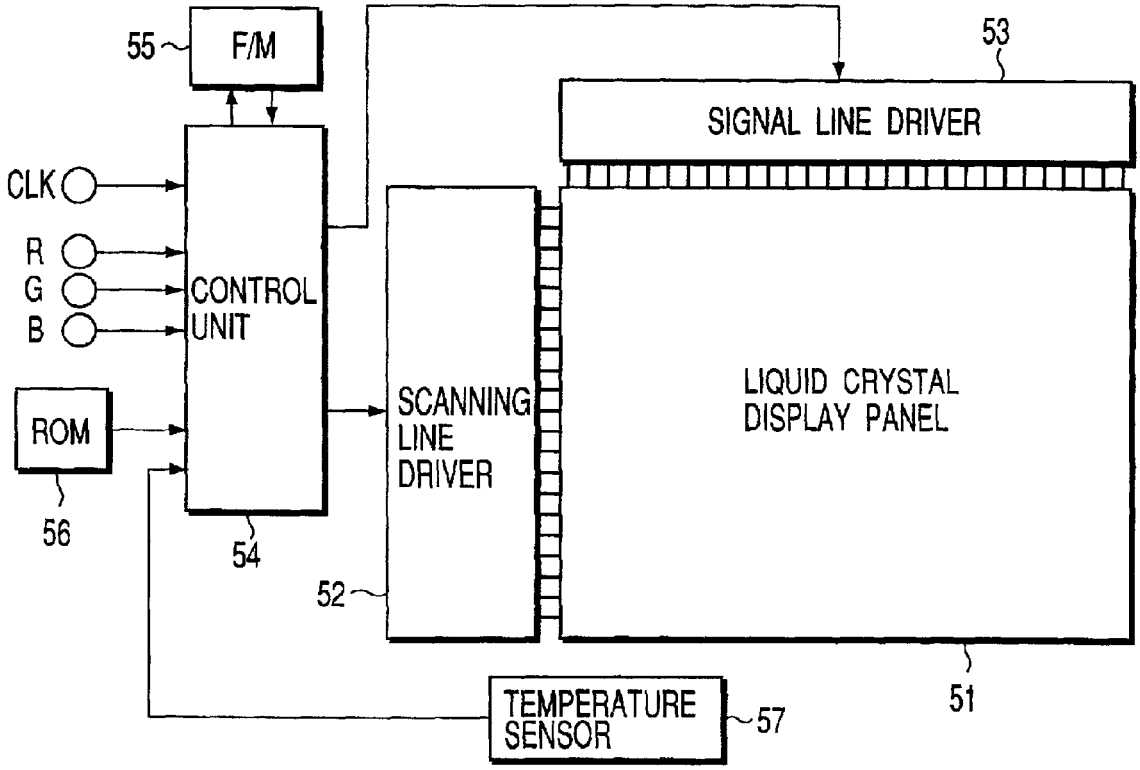
FIG. 10 is a block diagram of the liquid crystal display device and its associated control circuits according to an embodiment of the present invention.

FIG. 10 is a block diagram of the liquid crystal display device and its associated control circuit according to an embodiment of the present invention.

A liquid crystal display panel 51, a scanning line drive circuit 52 and a signal line drive circuit 53 remain unchanged in configuration from those shown in FIGS. 6 or 7. The scanning line drive circuit 52 and the signal line drive circuit 53 are connected to receive signals from a control unit 54. A field memory (F/M) 55 is connected to the control unit 54. Through the use of the field memory, the control unit is allowed to drive the liquid crystal display panel with each of two fields in one frame.

Connected with the control unit 54 is a ROM 56 (ROM table) that stores data corresponding to the difference in absolute value between the voltage of positive polarity (write voltage) applied to the liquid crystal layer in one field and the voltage of negative polarity (reset voltage) applied to the liquid crystal layer in the other field. That is, the ROM 56 is stored with data corresponding to the voltage shift ΔV. Specifically, data corresponding to such characteristics as shown in FIGS. 3, 4 and 5, i.e., data representing the relation between the reset voltage and the voltage shift ΔV is stored in the ROM 56.

A temperature sensor 57 is connected to the control unit 54. The monostable ferroelectric liquid crystal has a slow response to the rising edge of the write voltage (particularly low to intermediate voltage). For this reason, in view of time averaging of the hold voltage of the liquid crystal layer, the polarity-dependent difference in speed of response results in further greater asymmetry. Thus, corrections are made on the data stored in the ROM 56 on the basis of temperature information detected by the temperature sensor 57. That is, the voltage shift ΔV is changed as shown at b, c and d in FIG. 3 according to ambient temperature.

The driving method of the embodiment will be described next.

In the field inversion driving in which signals of the same polarity are written onto all pixels in the same field, crosstalk is liable to occur. The use of signal line inversion driving in which the polarity is inverted for each signal line allows the effect of coupling between adjacent signal lines shifting the pixel potential to opposite polarity to be reduced. The use of scanning line inversion driving in which the polarity is inverted for each scanning line likewise allows the effect of coupling to be reduced, thus reducing crosstalk. Besides, the use of dot inversion driving in which the signal line inversion driving and the scanning line inversion driving are applied at the same time allows crosstalk to be reduced significantly.

In the present embodiment, it is desirable to use any one of the above three driving method. For pixels which exhibit opposite polarity in the same field, it is desired to make voltages applied to them at the time of alignment formation opposite in polarity to each other so that they are placed in such molecular alignment states as shown in FIGS. 8B and 8C.

Figure 11:
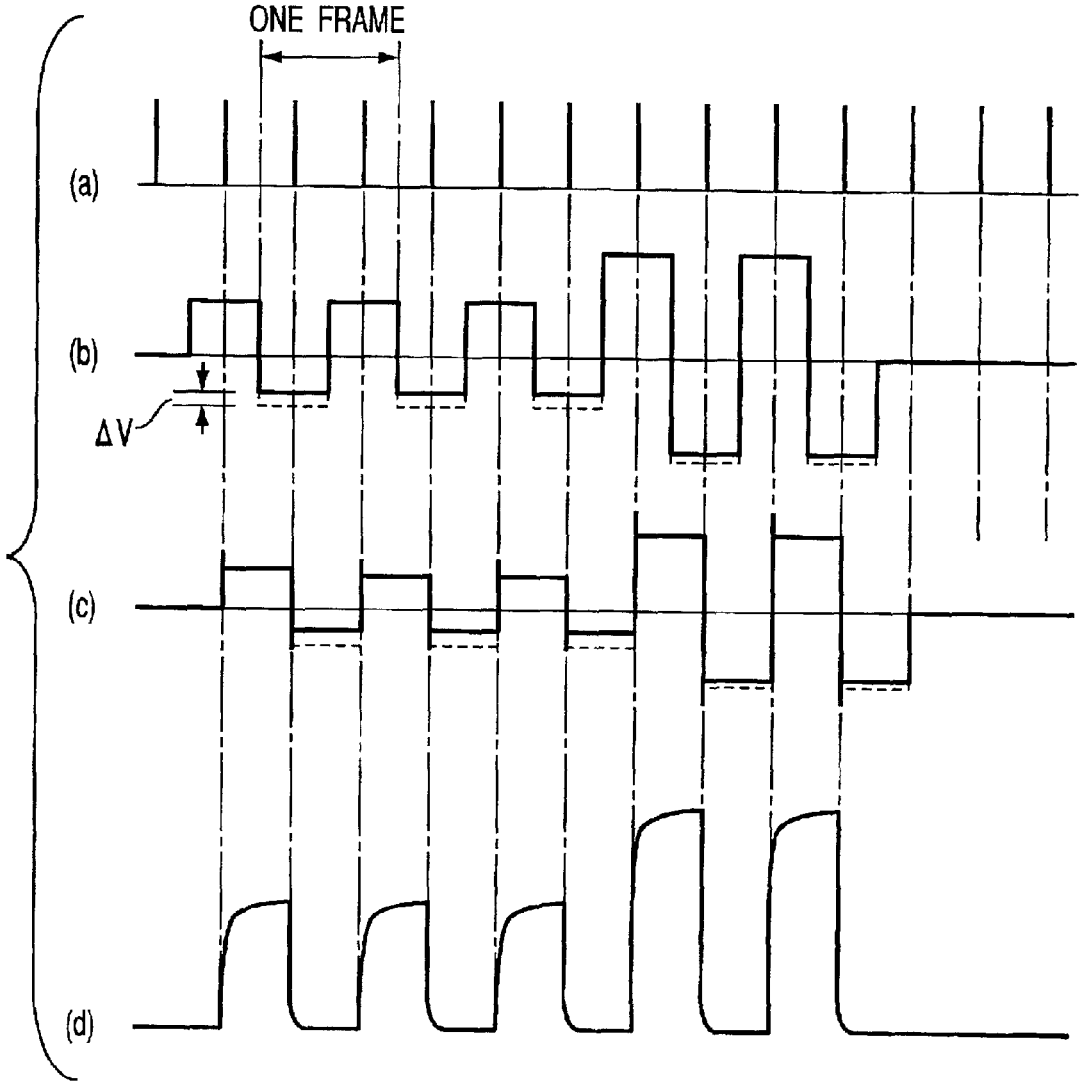
FIG. 11 is a timing diagram for use in explanation of the driving method for the liquid crystal display device according to an embodiment of the present invention.

FIG. 11 is a timing diagram for use in explanation of the driving method of the present embodiment.

FIG. 11*a* shows a control voltage signal (gate signal) applied from the scanning line drive circuit 52 to the switching elements of the liquid crystal display panel 51. FIG. 11*b* shows a display voltage signal applied from the signal line drive circuit 53 through a switching element to a pixel electrode. FIG. 11*c* shows pixel voltages applied between the pixel electrode and the opposite electrode. FIG. 11*d* shows the transmittance of the liquid crystal which varies according to the pixel voltage. In FIGS. 11*a* to 11*d*, reference is made to the potential on the opposite electrode.

One frame period is 1/60 sec (about 16.7 ms) and one field period is 1/120 sec (about 8.3 ms). The duration of a scan pulse for each scanning line (the duration of a gate pulse) is the one field period (8.3 ms) divided by the total number of scanning lines. For example, with XGA (768 scanning lines), the scan pulse duration is about 10.9 μs. The operation remains unchanged from that of usual active matrix liquid crystal display devices. That is, a TFT is rendered conductive (on) as long as a gate pulse is applied to its gate. A display signal from a signal line is written through the conducting TFT onto the corresponding pixel. While the TFT is rendered off, the charge stored in the pixel is held. However, the pixel voltage is lowered during the hold period because of dielectric relaxation of the ferroelectric liquid crystal. The larger the spontaneous polarization, the larger the amount by which the pixel voltage is lowered. The larger the storage capacitance, the smaller the amount.

As shown in FIG. 11*b*, in one field, a voltage of positive polarity (write voltage) corresponding to a display signal (image signal) is applied to a pixel electrode and, in the other field, a voltage of negative polarity (reset voltage) is applied. The reset voltage is one obtained by shifting a voltage of negative polarity equal in absolute value to the write voltage in the positive direction by ΔV. Data of the voltage shift ΔV has been previously stored in the ROM 56 in FIG. 10 according to the value of the write voltage. As shown in FIG. 11*c*, the positive and negative pixel voltages applied between the pixel electrode and the opposite electrode become asymmetrical. However, as described already, positive and negative voltages of substantially the same magnitude are applied to the liquid crystal layer itself. In view of time averaging, therefore, little DC is applied to the liquid crystal layer itself.

In order to apply positive and negative voltages of substantially the same magnitude to the liquid crystal layer itself when the write voltage is zero or near zero, it is theoretically possible that the reset voltage should be set positive. However, since in the positive polarity the transmittance of the liquid crystal layer becomes higher than in the negative polarity, no clear black display can be obtained when the reset voltage is set positive. In such a case, therefore, it is desirable to set the reset voltage to zero or the voltage shift ΔV to zero. Thus, by setting the reset voltage to be zero or negative, it becomes possible to attain clear black display.

Figure 12A:
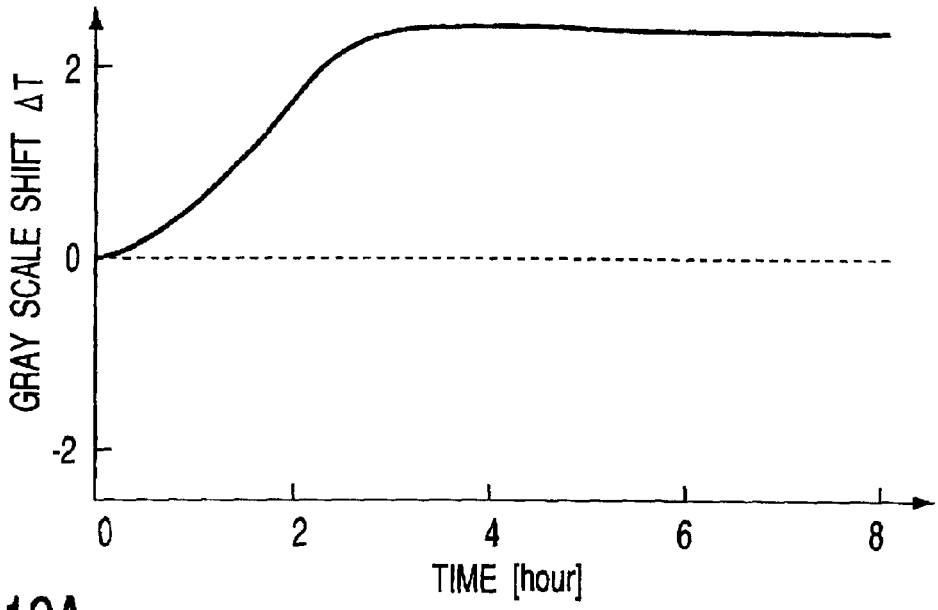
FIGS. 12A and 12B show gray scale shift characteristics of the liquid crystal display device according to an embodiment of the present invention and a comparative example.

In driving the liquid crystal display panel, when the pixel voltage is set symmetrical (the reset voltage is set as shown by a broken line in FIG. 11*b*), a DC component is applied to the liquid crystal layer itself, causing impurity ions to move to one side within the liquid crystal layer. For this reason, the V-T curve will shift as shown by a dotted line in FIG. 9. As a result, the transmittance of the liquid crystal layer becomes higher than that prior to shifting, causing positive image sticking. That is, the display characteristics shift in a direction to enlarge the gray scale. FIG. 12A shows measurements of gray scale shifts in the case of long-time driving. The positive image sticking is a phenomenon by which, after a pattern of black and white was displayed continuously for a long time, when a shade of gray is displayed on the entire display screen, areas where white was displayed are observed a little lighter than other areas. For example, with a total of 64 levels of gray, if the display characteristics are shifted by the amount corresponding to one level of gray, the positive image sticking will be perceived with ease.

Figure 12B:
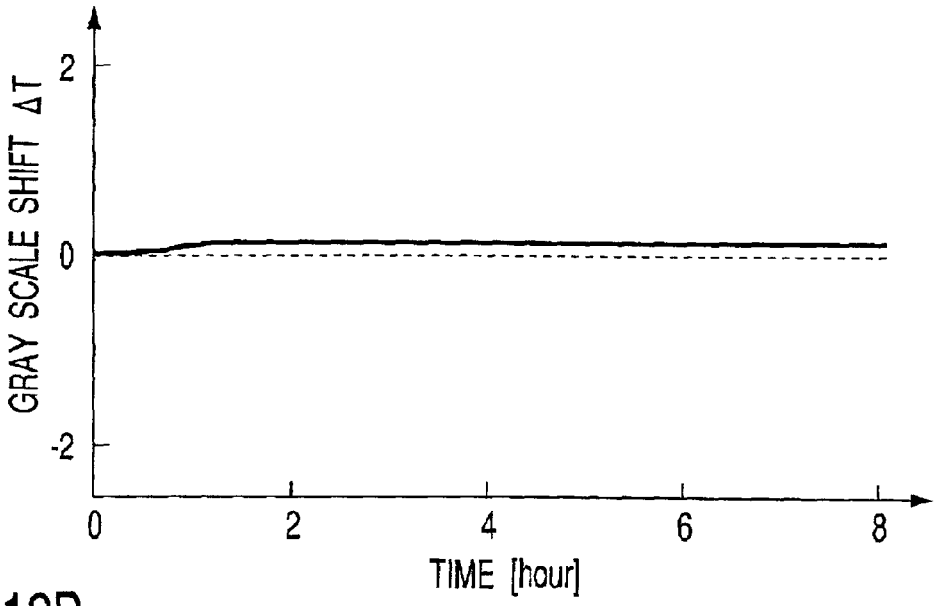

In contrast, in the present embodiment, the pixel voltage applied to the pixel electrode and the opposite electrode is set asymmetrical with respect to the reference level using the optimum voltage shift. That is, the reset voltage is set as shown by the solid line in FIG. 11*b*. Since the calculated values and the measured values of the voltage shift may differ, the shape of the voltage shift characteristics is determined based on the computational results and the voltage shift values are adjusted based on the measured values. In the present embodiment, as shown in FIG. 12B, the gray-scale shift was improved and no image sticking was observed. When the value of the write voltage is zero or near zero, a sufficient contrast was obtained by setting the reset voltage or the voltage shift ΔV to zero.

In the case of the asymmetrical driving as in the present embodiment, since the potential on the opposite electrode is common to all the pixel electrodes, the liquid crystal layer potential with respect to the opposite electrode potential varies from pixel to pixel. As a result, in view of the time average, a DC voltage half the voltage shift difference is applied to adjacent pixel electrodes. In the asymmetrical driving, since there is no DC component in the vertical direction at each pixel, no face pattern image sticking occurs. However, since a DC component in the horizontal direction remains because of the afore-mentioned reason, edge pattern image sticking may occur. Here, the face pattern image sticking is a phenomenon by which, after a pattern of black and white was displayed, when a shade of gray is displayed on the entire display screen, areas where white was displayed look different in brightness from areas where black was displayed. The edge pattern image sticking is such a phenomenon that a pattern looks different in brightness from an adjacent pattern at a boundary area between the patterns.

Methods for preventing the edge pattern image sticking include eliminating a DC component between pixels through liquid-crystal alignment adapted for inversion driving, such as signal line inversion driving, and inserting a rib type of spacer between each column of pixels to thereby stop the movement of ions in the horizontal the direction. However, the gap between electrodes is of the order of 1 to 2 $\mu$m in the vertical direction and 5 to 15 $\mu$m in the horizontal direction. Thus, the DC component of the electric field in the horizontal direction is weak. The potential distribution between pixels is greatly affected by the potentials on interconnect lines. For this reason, the edge pattern image sticking is less likely to occur than the face pattern image sticking. Therefore, the edge pattern image sticking due to asymmetrical driving seldom becomes a problem unless use is made of a liquid crystal material which is particularly large in the quantity of impurities.

In the present embodiment, the effects of the so-called level shift voltage which is the voltage shift due to the gate-source overlap capacitance (parasitic capacitance) of TFTs are neglected. This corresponds to the case where the parasitic capacitance is small or the case where the level shift-down and shift-up voltages are canceled independently of the liquid crystal capacitance by performing compensative addressing for switching distortion (see K. Suzuki, EuroDisplay' 87) through the use of such as Cs on gate structure as shown in FIG. 7.

Thus, according to the present embodiment, the magnitude of the voltage impressed between the opposite electrode and pixel electrode is made different between one field and the other field and the voltage shift $\Delta V$ is changed according to the write voltage. For this reason, the magnitude of the voltage impressed across the liquid crystal layer in one field can be made substantially equal to that in the other field over the entire voltage range. Accordingly, the application of a DC component to the liquid crystal layer can be suppressed, allowing image sticking to be prevented and the display characteristics of the liquid crystal display device to be improved.

Additional advantages and modifications will readily occur to those skilled in the art. Therefore, the invention in its broader aspects is not limited to the specified details and representative embodiments shown and described herein. Accordingly, various modifications may be made without departing from the spirit or scope of the general inventive concept as defined by the appended claims and their equivalents.

What is claimed is:

1. A method for driving an active matrix type liquid crystal display device including a first electrode, a second electrode, and a liquid crystal layer interposed between the first and the second electrodes, and the liquid crystal layer having a larger polarization when a voltage of a first polarity is applied to the first electrode against the second electrode than that when a voltage of a second polarity different from the first polarity is applied to the first electrode against the second electrode, the method comprising:

dividing a frame into a first field and a second field;

applying a first voltage of the first polarity to the first electrode during the first field;

generating a second voltage from the first voltage by changing its polarity, wherein a magnitude of the second voltage is modified by an amount of $\Delta V$ ($\Delta V>0$) based on a magnitude of the first voltage in a direction of the first polarity when the first voltage is not zero and the amount of $\Delta V$ changes with the magnitude of the first voltage; and applying the second voltage to the first electrode during the second field.

2. The method according to claim 1, wherein the amount $\Delta V$ is determined based on a magnitude of the polarization of the liquid crystal layer.

3. The method according to claim 1, wherein the amount $\Delta V$ is determined based on a response characteristics of the liquid crystal layer.

4. The method according to claim 1, wherein the amount $\Delta V$ is determined based on a temperature of the liquid crystal display device.

5. The method according to claim 1, wherein the liquid crystal display device further includes a storage capacitor connected to the first electrode.

6. The method according to claim 5, wherein the amount $\Delta V$ is determined based on a capacitance of the storage capacitor.

7. The method according to claim 1, wherein the liquid crystal layer is obtained by monostabilizing a ferroelectric liquid crystal that exhibits phase transition among isotropic phase, cholesteric phase, and chiral smectic C phase.

8. The method according to claim 1, wherein the liquid crystal display device further includes an insulating film interposed between the liquid crystal layer and the first electrode.

9. The method according to claim 8, wherein the insulating film is an alignment film.

10. The method according to claim 1, wherein the liquid crystal display device further includes an insulating film interposed between the liquid crystal layer and the second electrode.

11. The method according to claim 10, wherein the insulating film is an alignment film.

12. The method according to claim 1, wherein the second voltage is of the second polarity.

13. The method according to claim 1, wherein the larger a value of the first voltage, the greater the amount $\Delta V$ is.

14. The method according to claim 1, wherein the amount $\Delta V$ has a peak when the first voltage has a certain value.

15. The method according to claim 1, wherein the amount of $\Delta V$ is determined based on a pre-stored mapping relationship between the amount of $\Delta V$ and the magnitude of the first voltage.

* * * * *

UNITED STATES PATENT AND TRADEMARK OFFICE

CERTIFICATE OF CORRECTION

PATENT NO. : 6,975,297 B2
DATED : December 13, 2005
INVENTOR(S) : Saishu et al.

It is certified that error appears in the above-identified patent and that said Letters Patent is hereby corrected as shown below:

Title page,
Item [75], Inventors, change "Kobayahi," to -- Kobayashi, --.

Column 10,
Line 17, change "on a response" to -- on response --.

Signed and Sealed this

Fourteenth Day of February, 2006

JON W. DUDAS
*Director of the United States Patent and Trademark Office*